US011103051B2

(12) United States Patent
Kersting

(10) Patent No.: US 11,103,051 B2
(45) Date of Patent: Aug. 31, 2021

(54) BACKPACK, SHELTER, RAIN PONCHO, AND PACK COVER COMBINATION

(71) Applicant: Lydon Kersting, Park Ridge, NJ (US)

(72) Inventor: Lydon Kersting, Park Ridge, NJ (US)

( * ) Notice: Subject to any disclaimer, the term of this patent is extended or adjusted under 35 U.S.C. 154(b) by 0 days.

(21) Appl. No.: 16/893,800

(22) Filed: Jun. 5, 2020

(65) Prior Publication Data

US 2020/0383458 A1 Dec. 10, 2020

Related U.S. Application Data

(60) Provisional application No. 62/858,609, filed on Jun. 7, 2019.

(51) Int. Cl.

| | |
|---|---|
| ***A45F 4/04*** | (2006.01) |
| ***A45F 4/12*** | (2006.01) |
| ***E04H 15/46*** | (2006.01) |
| ***A41D 13/04*** | (2006.01) |
| *A41D 3/04* | (2006.01) |

(52) U.S. Cl.

CPC ..... *A45F 4/04* (2013.01); *A45F 4/12* (2013.01); *A41D 3/04* (2013.01); *E04H 15/46* (2013.01)

(58) Field of Classification Search

CPC ... A45F 4/04; A45F 4/12; E04H 15/30; E04H 15/46; A41D 3/04

USPC ..... 224/154; 135/95, 96

See application file for complete search history.

(56) References Cited

U.S. PATENT DOCUMENTS

| | | | | |
|---|---|---|---|---|
| 2,792,844 | A * | 5/1957 | Clark | A45F 4/04 224/259 |
| 5,277,349 | A * | 1/1994 | Rowe | A45F 4/04 135/96 |
| 7,374,071 | B2 * | 5/2008 | Lavelle | A41D 3/08 2/94 |
| 7,717,309 | B1 * | 5/2010 | Lehmberg | A45F 4/04 224/154 |
| 10,731,377 | B2 * | 8/2020 | Cassetta | E04H 15/38 |
| 2005/0258294 | A1 * | 11/2005 | Dickson | A45F 4/04 242/388.3 |
| 2005/0284510 | A1 * | 12/2005 | Rau | A45F 4/02 135/96 |
| 2010/0018559 | A1 * | 1/2010 | Bauer | B05B 13/0285 135/96 |
| 2013/0014794 | A1 * | 1/2013 | Jin | E04H 15/46 135/139 |

(Continued)

*Primary Examiner* — Justin M Larson

(74) *Attorney, Agent, or Firm* — Meagher Emanuel Laks Goldberg & Liao, LLP

(57) ABSTRACT

Disclosed is a backpack, shelter, rain poncho/rainfly/pack cover combination. The combination is configured such that the tent is stored in a zippered front pocket of the backpack, a removable hooded rain poncho/rainfly/pack cover is stored in a pocket on the top of the pack, and a telescoping frame sits in an integrated sleeve within the pack, preferably against a foam backpanel. The front of the backpack is configured to form a wall of the tent, when the tent is erected. The telescoping frame typically consists of (i) one horizontal hollow tube arm; (ii) an adjustable hinge connected to each end of the horizontal tube arm, each hinge configured to lock at 90 degrees as well as a wider angle; and (iii) a vertical leg assembly connected to each adjustable hinge, each vertical leg assembly containing two telescoping hollow tubes.

20 Claims, 4 Drawing Sheets

(56) References Cited

U.S. PATENT DOCUMENTS

| | | | | |
|---|---|---|---|---|
| 2015/0342327 | A1* | 12/2015 | Berkson | A45F 4/04<br>224/154 |
| 2018/0343934 | A1* | 12/2018 | Riley | A45F 3/04 |
| 2019/0298041 | A1* | 10/2019 | Villaruz | A41D 13/0007 |
| 2020/0383458 | A1* | 12/2020 | Kersting | A45F 4/04 |

* cited by examiner

BACKPACK, SHELTER, RAIN PONCHO, AND PACK COVER COMBINATION

CROSS-REFERENCE TO RELATED APPLICATIONS

This application claims the benefit of U.S. Provisional Patent Application No. 62/858,609, filed on Jun. 7, 2019, which is incorporated in its entirety herein.

FIELD OF INVENTION

The present invention relates to backpacks, and specifically backpack-shelter-poncho-pack cover combinations, which may have applications to, e.g., backpacking, camping, emergency relief services, military activities, and other related activities.

BACKGROUND

Portable, lightweight shelters, such as tents, have been used for many years where people are, e.g., hiking and camping. Typically, these shelters include tent poles that can be folded or broken down, and the entire shelter compressed and configured to be small enough to carry, such as within a backpack. Backpacks are generally carried by means of two straps arranged in such a way so that the pack can be easily carried over the shoulders and often include a belt at the waist to balance the load across the hips. However, backpackers typically need more than just shelter—they also typically carry at least a sleeping pad and sleeping bag, as water bottles, food, etc., which are also stored within the pack or affixed by ties or other connectors to the outside of the pack. This can make setting up a standalone shelter carried in a pack difficult or dangerous depending on the situation (for example, in the dark, when the person has a disability or suffering from an impairment such as injury or exhaustion, during inclement weather, etc.), especially as many shelters are intended to be used and set up by a single individual.

Similar issues arise where temporary shelters are required—in disaster relief or military situations, the need to be able to easily, quickly, and safely set up a shelter from the elements can be critical.

It is an object of the invention to provide a combined backpack and shelter system with the back padding and telescoping pole internal frame of the pack doubling as the support structure to configure the tent, including features that can also provide a rain poncho and backpack cover.

BRIEF SUMMARY

Disclosed is a system for backpacking and camping, including a backpack, a telescoping frame configured to be stored against or integrated with a foam backpanel in an integrated sleeve within the backpack, a removable rain poncho configured to be stored within a top pocket of the backpack, and a tent configured to be stored within a zippered front pocket of the backpack. The tent has a base, a roof, and walls, and is attached, combined, or otherwise connected to the backpack such that the front of the bag forms an inner wall of the tent at one end of the tent when it is erected.

Optionally, the telescoping frame includes a first hollow telescoping vertical leg assembly connected to a first adjustable hinge, which is connected to a horizontal hollow tube arm, which is connected to a second adjustable hinge, which is connected to a second hollow telescoping vertical leg, wherein each adjustable hinge is capable of locking to at least two different angles—a 90-degree angle, and at the at least one angle greater than 90 degrees. In some cases, the adjustable hinge utilizes a spring plunger pin (such as a ball-nose plunger spring pin) or other pin mechanism to lock at an angle greater than 90 degrees, and/or each hollow telescoping vertical legs includes a hollow metal cylinder that can fit inside another hollow metal cylinder, where the two cylinders can lock together when a retractable button on the inner cylinder is positioned such that the button fits within a port on the outer cylinder. In some cases, the telescoping frame is stored by locking the hinges at 90 degrees and sliding each inner metal cylinder into the corresponding outer metal cylinder, placing the frame against the foam backpanel, and securing the telescoping frame and the foam backpanel within the integrated sleeve such that the foam backpanel is closer to a user's back and the frame is on the inside of the pack such that it forms a support structure capable of cushioning the user's back and spreading a load more evenly over a wide surface area. Said differently, the telescoping frame that is used to support the tent can be collapsed and inserted into the backpack in order to function as a traditional backpack frame when, e.g., hiking.

Optionally, the integrated sleeve may include an elastic band and/or zipper sewn to the inner back of the pack to store the frame, or be configured to store, e.g., a laptop and/or a water bladder.

Optionally, the rain poncho is capable of being deployed as a standalone garment without the pack or tent, and/or may comprise an adjustable hood, a portion adapted to cover at least a portion of a user's body, and a portion adapted to cover the backpack. In some cases, the rain poncho includes snap buttons or hook-and-loop fasteners adapted to decrease the length of the pack cover portion, on the side of the user's back.

Optionally, the zippered front pocket must be opened to deploy the tent, the base of the tent including a waterproof floor shaped like two trapezoids that share a common base. Optionally, another zipper is added to the front of the pack/inner wall of the tent such that a person inside the tent can access at least some of the inside of the pack while sitting in the tent. In some cases, the tent is capable of being formed by expanding the telescoping frame and locking adjustable hinges of the frame in an angle greater than 90 degrees in order to form three legs of a trapezoid without the longer base. The frame legs are run through sleeves on an exterior of the tent and anchored in grommets in the base of the tent. In some cases, the tent walls and roof on a side of the pole sleeves closer to the backpack are constructed of bug-mesh with one vertical and one horizontal zipper meeting at a common point on one wall. In some cases, a horizontal frame arm of the telescoping frame is clipped to the top of the tent via clips, and/or the walls and roof on a side of the pole sleeves opposite the side closer to the backpack are constructed of waterproof fabric. In some cases, the tent roof has bumpers sewn into the seams to direct water off the roof. In some cases, at an end of the tent opposite the backpack, the foam backpanel is placed in a vented sleeve constructed of layers of waterproof fabric and bug mesh and connected to the floor, walls, and ceiling of the tent. In some cases, a flap attached to the roof above the integrated sleeve is configured to be over the sleeve and backpanel and is configured to be anchored to the ground.

Optionally, stakes are placed through loops in a base of the tent and anchored to the ground to provide more wall tension.

Optionally, the rain poncho can be removed from the pack and used as a rainfly. In some cases, grommets on the rainfly are capable of being placed underneath tent grommets and secured to tent poles, clips on the rainfly are capable of clipped onto a horizontal frame arm, stakes are capable of being placed through loops on the rainfly to provide wall tension, and at least one stake is capable of being placed through a rain poncho hood drawstring and a pack carrying handle to provide tension and create channels to direct water off the roof.

DETAILED DESCRIPTION

Disclosed herein is a system that incorporates a backpack, shelter, rain poncho/rainfly/pack cover combination that satisfies the need for quality, affordable backpacking and camping gear. The disclosed approach will make outdoor excursions more affordable for low-income populations and can also provide temporary portable shelter for people fleeing disaster.

The system includes a backpack, a tent, a frame, and a rain cover.

Figure 1A:
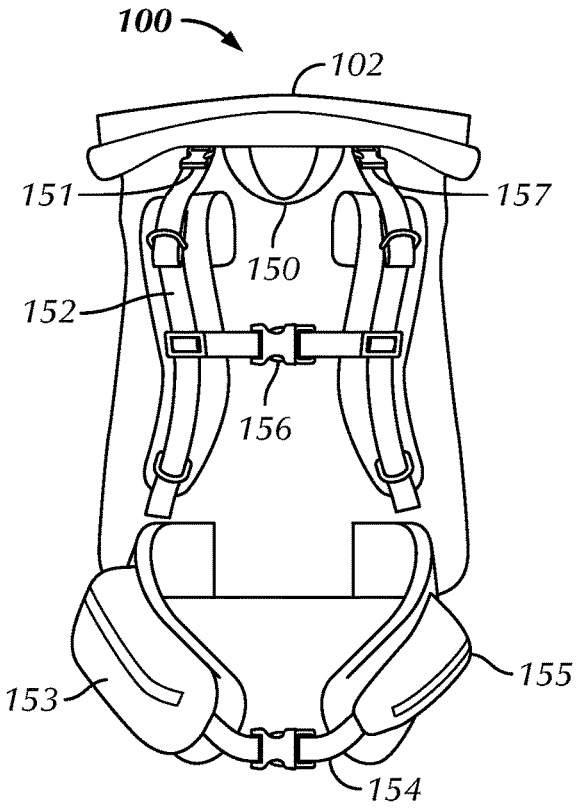
FIG. 1A is a rear view of a backpack, showing some of the elements of the present invention.
Figure 1B:
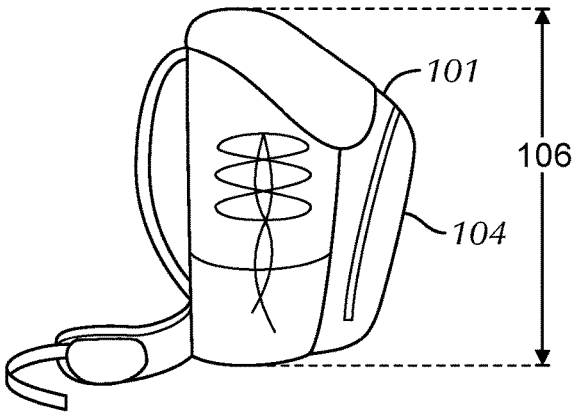
FIG. 1B is a side view of a backpack, showing some of the elements of the present invention.
Figure 1C:
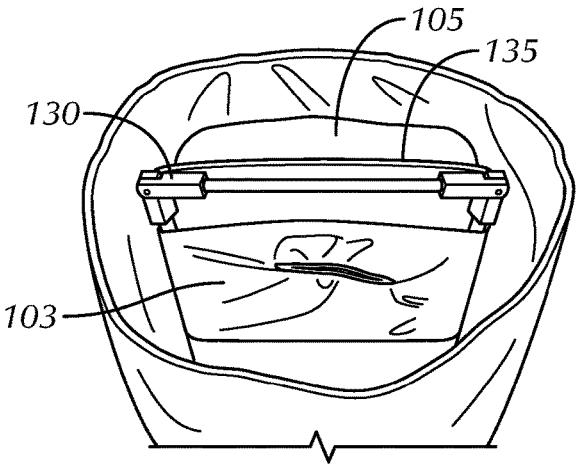
FIG. 1C is a depiction of an inside of a backpack, showing some of the elements of the present invention.

As seen in FIGS. 1A-1C, the backpack 100 includes at least three components: (i) a front pocket 101, which is preferably zippered, on the front 104 of the backpack 100; (ii) a top pocket 102 on a top portion of the backpack 100; and (iii) an integrated sleeve 103 within the interior 105 of the backpack 100. As seen in FIG. 1B, the backpack itself, with all components packed away as appropriate typically has an overall height 106 between 15" and 30", and preferably around 18" to 22".

Figure 2A:
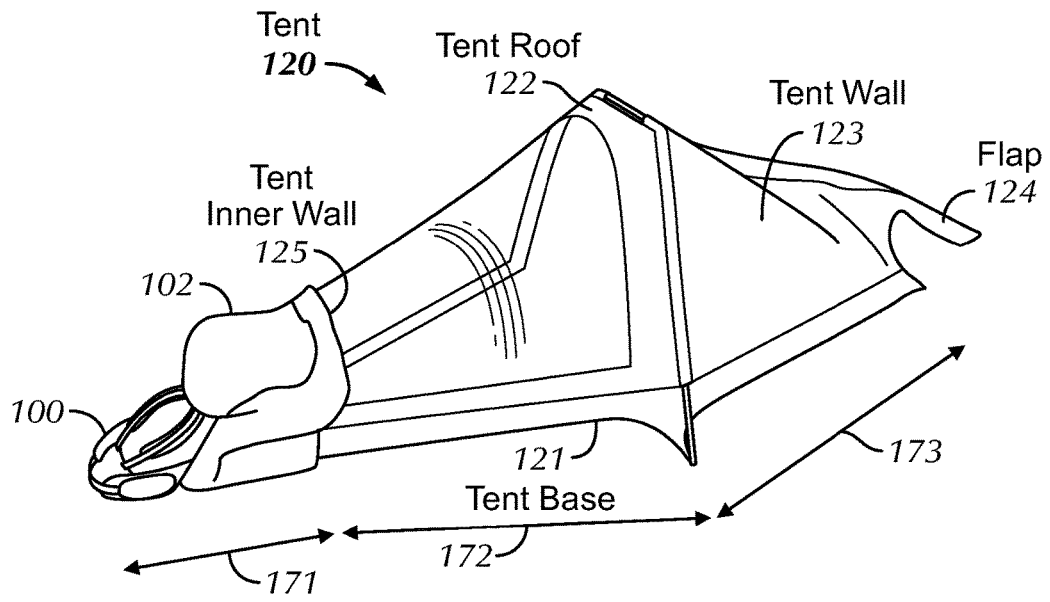
FIG. 2A is a side view of a shelter without a rainfly.

The front pocket of the backpack is used to store a tent. As seen in FIG. 2A, the backpack 100 and the tent 110 are configured such that when the tent is erected, the tent has a base 121, a roof 122, and walls 123, and the front of the bag forms an inner wall 125 of the tent at one end of the tent (that is, the back of the backpack is on the exterior of the erected tent). Preferably, the tent is permanently integrated or attached to the backpack, although in some embodiments, it can be removably integrated or attached (e.g., via buttons, snaps, or zippers) to allow for, e.g., easier cleaning and/or repair, or to allow a user to use different sized tents as needed. In one embodiment, the same backpack can be used with multiple different sized tents.

Figure 2C:
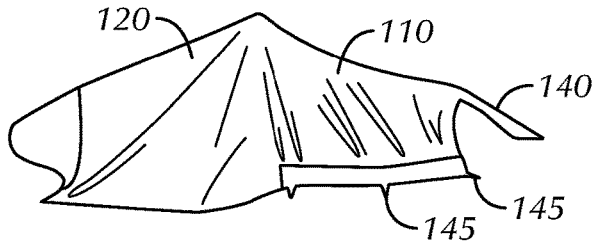
FIG. 2C is a front view of a shelter, showing crimps and a flow path for, e.g., rain.

In some embodiments, when erected, the tent and backpack combination can be considered to have three sections; (i) the external backpack, having a length 171; (ii) a first portion of the tent having a length 172; and (iii) a second portion of the tent having a length 173. As seen in FIG. 2A, the first portion of the tent may optionally include a bug mesh portion, using a material that allows air to freely enter, but prevents most bugs from entering. As seen in FIG. 2C, the second portion also includes a flap 140 that can be used to cover the entrance (not shown) to the tent.

In some embodiments, the tent comprises or consists essentially of water resistant or water repellant material. In some embodiments, this material is, e.g., a polyester (such as silpoly—a polyester fabric coated with a silicone/PU layer on one side, then a multi-pass PU coating on the other to create a highly waterproof/non-breathable fabric), nylons (such as nylon 6 or nylon 66), polypropylenes or polyethylenes (such as ultra-high molecular weight polyethylene (UHMwPE), such as that sold under the brand name Dyneema® by DSM), or other such materials. In some embodiments, the material may comprise a non-waterproof material which may be optionally coated with a waterproofing material such as Durashield™ polyurethane and silicone. In some embodiments, the test material is breathable. In some embodiments, the tent base has a different thickness than other portions of the tent. For example, in some embodiments, the tent base has a 7-mil or 8-mil thickness, while the walls and roof of the tent have a 5-mil thickness. In some embodiments, the tent base may be comprised of a different material than the tent walls. For example, in one embodiment, the tent base may be high density spunbond polyethylene fibers coated with a waterproofing material, while the tent walls are silpoly.

Figure 2B:
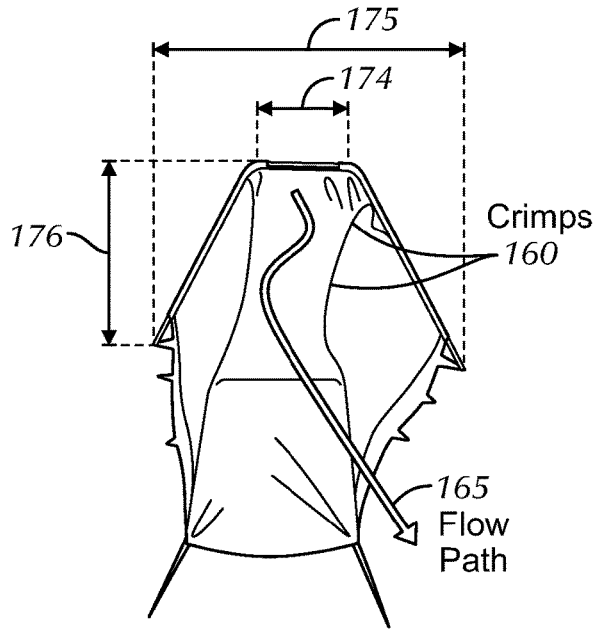
FIG. 2B is a side view of a shelter with a rainfly.

As seen in FIG. 2B, the tent may be configured such that the tent has an overall width 175 and overall height 176. In some embodiments, the overall width 175 may be 100" or less, such as 80" or less, such as 70" or less, such as 60" or less, or 48" or less. In some embodiments, the overall width 175 is at least 48", such as between 48" and 100", between 48" and 80", between 48" and 70", or between 48" and 60". In some embodiments, the overall width 175 is about 48". In some embodiments, the overall height 176 may be 80" or less, such as 60" or less, such as 50" or less, such as 40" or less, and/or such as 36" or less. In some embodiments, the overall height 176 is at least 24", at least 27", or at least 30". In some embodiments, the overall height 176 is between 40" and 80", between 31" and 60", between 31" and 50", between 31" and 31", or between 31" and 36". In one embodiment, the overall height 176 is about 31".

In some embodiments, the tent has a tent roof with a roof width 174, which may be 20" or less, 17" or less, and/or 14" or less. In some embodiments, the tent roof has a roof width 174 between 10" and 20", 10" and 17", or 10" and 14". In some embodiments, the roof width is about 14". The tent roof may include crimps or other features 160 configured such that when the tent is erected, there is a target flow path 165 for any rain that falls on the tent to follow.

In some embodiments, the tent includes grommets or loops 165 attached to the base of the tent, such that stakes can be placed through the loops and anchored to the ground to provide more wall tension.

The top pocket of the backpack is used to store a removable rain poncho. It is in the top pocket to allow it to be readily accessible regardless of what other equipment may be in or on the backpack. In some embodiments, the rain poncho is comprised of the same material as the tent. In other embodiments, the rain poncho is comprised of a different material. For example, in some embodiments, the rain poncho may be comprised of a polymeric sheet, such as a polyethylene or polypropylene film. In some embodiments, the rain poncho has been treated to be hydrophobic. In some embodiments, the rain poncho is breathable or as been treated to be breathable. In some embodiments, the rain poncho is the same thickness as the tent walls. In other embodiments, the rain poncho is thinner than the tent walls. In still other embodiments, the rain poncho is thicker than the tent walls. In some embodiments, the rain poncho is designed to have overlapping layers of material that are not completely sealed at the edges, allowing some venting to occur, while still providing protection from falling rain.

In some embodiments, the rain poncho is removed from the pack and used as a rainfly. See FIG. 2C, where the rainfly 120 is positioned over a portion of the tent 110, such as the portion that includes the bug mesh (see FIG. 2A). In some embodiments, grommets (not shown) on the rainfly are placed underneath tent grommets or loops 165 and is secured to the tent poles (discussed below). Clips on the rainfly are clipped onto a horizontal frame arm of the tent poles (discussed below). Stakes are placed through loops on the rainfly to provide wall tension. In some embodiments, a stake is placed through a rain poncho hood drawstring and a pack carrying handle 150 is then anchored to the ground to provide tension and create channels to direct water off the roof.

Figure 3:
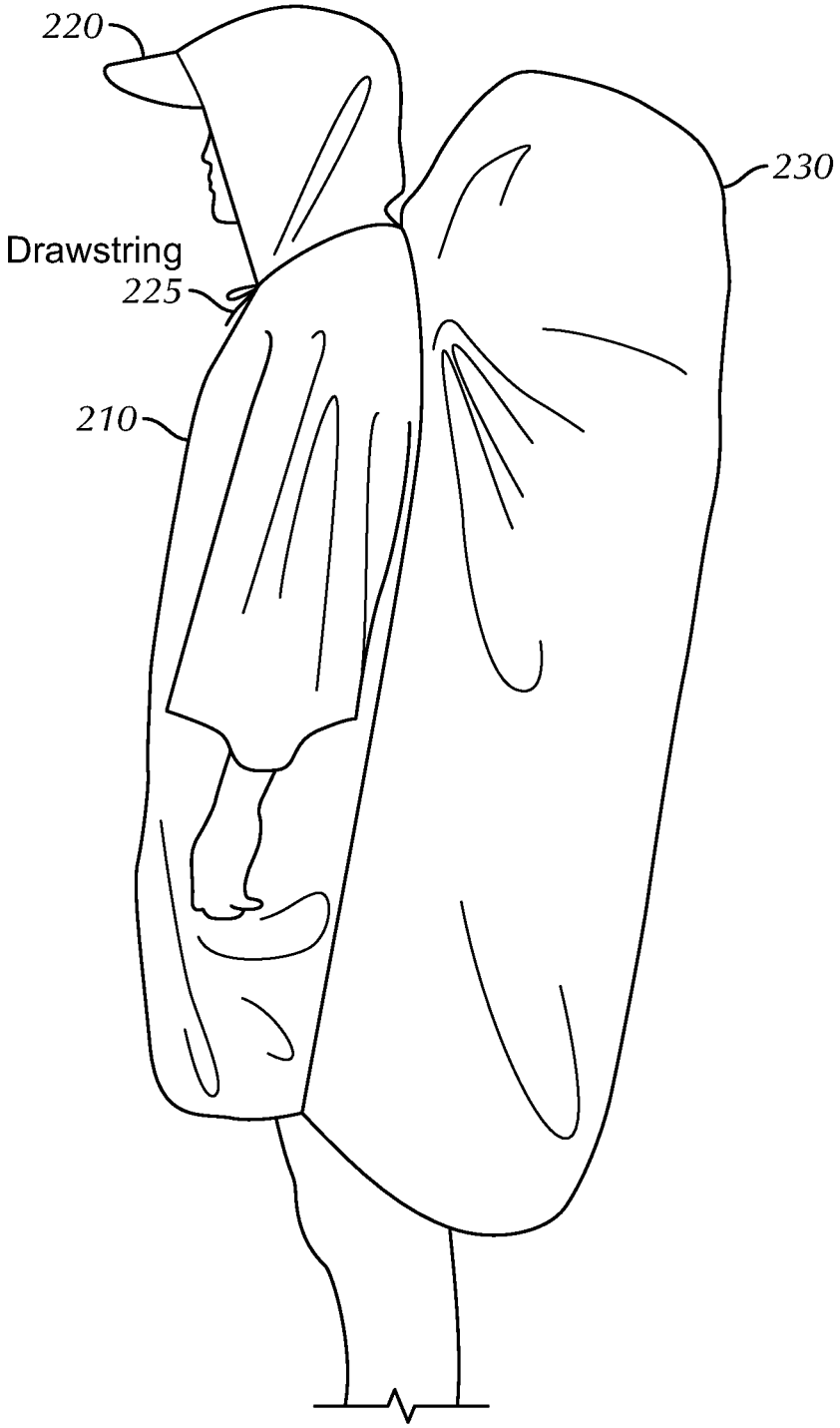
FIG. 3 is a side view of a separately deployed rain poncho.

In some embodiments, the rain poncho/rainfly/pack cover can be deployed separately from the tent. As seen in FIG. 3, the rain poncho may have a first portion 210 that is configured to lie over the user's body, a second portion 220 that forms a hood to cover the user's head, the hood being adjustable via the use of drawstrings 225, and a third portion 230 configured to cover some or all of the backpack. In some embodiments, the third portion 230 intended to cover some or all of the backpack can be shortened via snap buttons or hook-and-loop fasteners and draped over the user's back.

Figure 4A:
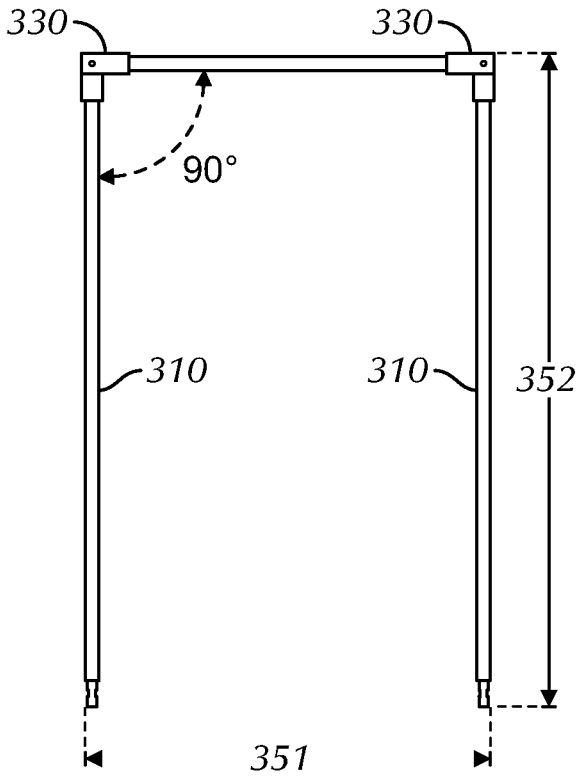
FIG. 4A is a front view of a telescoping frame with the legs locked at 90 degrees, ready for storing in the backpack.

The integrated sleeve 103 contains a telescoping frame 130 which is stored in the sleeve against a foam backpanel 105. As seen in FIG. 4A, the telescoping frame generally comprises two vertical leg assemblies 310, one horizontal arm 320, and two adjustable hinges 330, where the adjustable hinges 330 are connected to different ends of the horizontal arm 320, and each adjustable hinge is also connected to a vertical leg assembly 310. In some embodiments, each hinge locks via a spring plunger pin, and preferably using a ball-nose spring plunger pin. In some embodiments, another internal pin may be used.

When in a "collapsed" form (FIG. 4A) which is the form it is in when it is within the backpack against the foam backpanel, the adjustable hinges are locked at a 90 degree angle (that is, the angle between the horizontal arm 320 and the vertical leg assembly 310 is 90 degrees), the width 351 of the "collapsed" telescoping frame may be between 9" and 24", and preferably between 12" and 16", and still more preferable 14". The height 352 of the "collapsed" telescoping frame may be between 10" and 30", preferably between 16" and 22", and still more preferably 19". Preferably, when in place in the backpack, the telescoping frame replaces a more traditional internal or external backpack frame, with the frame against a foam backpanel that cushions the user's back and spreads load more evenly over a wider surface area.

Figure 4C:
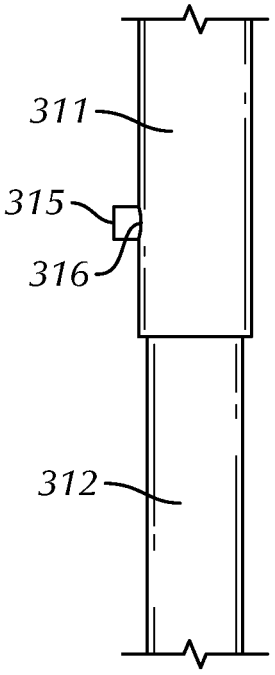
FIG. 4C is a close-up of one embodiment of a locking mechanism for the legs of the telescoping frame.
Figure 4B:
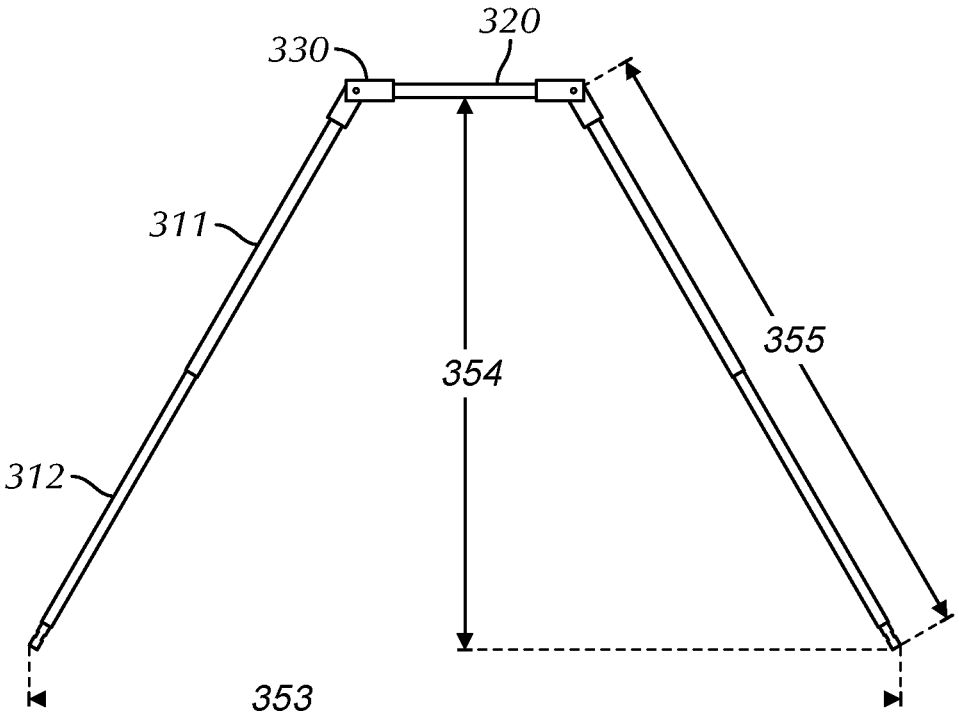
FIG. 4B is a front view of a telescoping frame with the legs extended and locked at an angle greater than 90 degrees, ready for use as the frame of the tent.

Referring to FIGS. 4B and 4C, in some embodiments, each vertical leg assembly 310 comprises two or more telescoping hollow tubes 311, 312, where the lower tube(s) 312 of each vertical leg assembly slides into the upper tube 311. In some embodiments, when extended, the telescoping hollow tubes 311, 312 lock into position using a retractable pin button 315 (see FIG. 4C) that fits through an appropriately sized, and appropriately located, hole 316 in the outer hollow tube 311. In some embodiments, the hole 316 is within 1-3 inches of an end of tube 311, and the retractable pin button 315 is within 0.5-3 inches of an end of tube 312. As can be seen in FIG. 4B, the vertical leg assembly 310 comprised of the telescoping hollow tubes 311, 312 can lock into an angle greater than 90 degrees (that is, the angle between the horizontal arm 320 and the vertical leg assembly 310 is greater than 90 degrees). In some embodiments, the angle that is formed is less than 135 degrees. In some embodiments, the angle is between 110 and 130 degrees, or between 115 and 125 degrees. Thus, in some embodiments, the adjustable hinges are capable of locking at both a 90-degree angle and at the at least one angle greater than 90 degrees. In some embodiments, the hinges are capable of locking at only two angles—90 degrees and an angle greater than 90 degrees—while in other embodiments, it may be beneficial to allow the legs to lock at multiple angles.

In some embodiments, the "extended" telescoping frame (FIG. 4B) has a maximum width 353 of 0.5 to 2 inches more than the width of the tent, and a height 354 less than 2 inches greater than the internal height of the tent. In some embodiments, the width 353 is between 40" and 80", preferably between 40" and 60", and more preferably between 40" and 50". In some embodiments, the height 354 is between 20" and 60", preferably between 24" and 48", and more preferably between 24" and 36". In some embodiments, the length of the extended legs 355 is between 24" and 72", preferably between 24" and 60", and more preferably between 30" and 42".

The telescoping frame can comprise any appropriate material. In preferred embodiments, the frame comprises or consist of aluminum or aluminum alloys (e.g., aluminum alloy 7075), steel or alloyed steel, or a polymeric or carbon fiber-containing material.

In some embodiments, the integrated sleeve includes an elastic band and/or zipper is sewn to the inner back of the pack, allowing the sleeve to store not only the frame and backpanel, but also simultaneously storing larger items like a laptop or water bladder.

Example

An example can be best understood in reference to FIG. 2A. In some embodiment, to erect the tent, the zippered front pocket is open and the tent is deployed. The tent has a waterproof floor shaped like two trapezoids that share a common base. The telescoping frame is removed from the backpack. The hinges are pivoted and locked at a wider angle via a spring plunger pin (such as a ball-nose plunger spring pin) or other internal pin mechanism). The lower vertical leg tubes are extended and locked into place via a button pin. The frame now forms three legs of a trapezoid without the longer base. The frame legs are run through sleeves on the exterior of the tent and anchored in grommets in the base of the tent. The horizontal arm is clipped to the top/roof of the tent via clips, or hook-and-latch fasteners attached to the top of the tent are fastened around the horizontal arm. At the end of the tent opposite the backpack, the foam backpanel may be placed in a vented sleeve constructed of layers of waterproof fabric and bug mesh and connected to the floor, walls, and ceiling of the tent. A flap 124 attached to the roof above the sleeve is pulled over the sleeve and backpanel and anchored to the ground. The tent walls and roof on the side of the pole sleeves closer to the pack (in FIG. 2A, the portion of the tent that is indicated as having length 172) are constructed of bug mesh with one vertical and one horizontal zipper meeting at a common point on one wall. The walls and roof on the side of the pole sleeves near the foam backpanel (in FIG. 2A, the portion of the tent that is indicated as having length 173) are constructed of waterproof fabric. The tent roof has bumpers (not shown) sewn into the seams to direct water off the roof.

The system may come in a variety of sizes, based on the needs to the user. In preferred embodiments, the combination is less than 10 pounds, such as a 4.8 lb. 60L backpack, tent, and rain poncho. Some embodiments may use extremely lightweight materials, and may have weights of less than 4 lb or less than 3 lb. The dimensions of the tent typically relate to the size of the backpack (which may come in, e.g., "small", "medium", and "large" sizes to more easily accommodate different body shapes or needs). For example, in some embodiments a "small" pack utilizes a 31" tall, 20 $ft^2$ base ventilated 1-person tent that deploys from the front pocket of the internal framed pack. The "medium" and "large" packs may comprise tents having larger dimensions. In some embodiments, the tent's dimensions may be adapted for, e.g., a 1-, 2-, 3-, 4-, 6-, or 8-person tent. In some embodiments, the tent may have a height of up to 40", up to 50", or up to 60", or up to 80", and may have square footage of up to 30 $ft^2$, 40 $ft^2$, 60 $ft^2$, 80 $ft^2$, or 100 $ft^2$.

The backpack is typically designed for manufacturing with a straightforward pack, tent, and poncho sewing pattern, easily machined, 3D printed, or CNC'd (machined using a computer numerical control (CNC) machine) hinges, and heritage mechanisms and hardware.

Referring to FIG. 1A, it can be seen that the backpack may also comprise various other components, including a handle/tent stake loop 150, load lifters 151, 157 shoulder straps with gear loops 152, a first hipbelt pocket 153, a hipbelt 154, a second hipbelt pocket 155 (which may be smaller than the first hipbelt pocket 153), and a sternum strap adjuster/emergency whistle 156.

The backpack may also include mesh side pockets adapted to carry water bottles or gear, and/or an elastic cord pattern on the exterior of the pack adapted for attaching gear.

Those skilled in the art will recognize, or be able to ascertain using no more than routine experimentation, many equivalents to the specific embodiments of the invention described herein. Such equivalents are intended to be encompassed by the following claims

What is claimed is:

1. A system for backpacking and camping, comprising:
   a. a backpack having a zippered front pocket, a top pocket, and an integrated sleeve within the backpack;
   b. a removable rain poncho configured to be stored in the top pocket;
   c. a tent configured to be stored in the zippered front pocket of the pack, the tent having a base, a roof, and walls, where the tent is connected to the backpack such that the front of the bag forms an inner wall of the tent at one end of the tent; and
   d. a telescoping frame stored in the integrated sleeve against a foam backpanel.

2. The system according to claim 1, wherein the telescoping frame comprises:
   a first hollow telescoping vertical leg assembly connected to a first adjustable hinge, which is connected to a horizontal hollow tube arm, which is connected to a second adjustable hinge, which is connected to a second hollow telescoping vertical leg,
   wherein each adjustable hinge is capable of locking at both a 90-degree angle and at the at least one angle greater than 90 degrees.

3. The system according to claim 2, wherein each adjustable hinge utilizes a spring plunger pin to lock at 90 degrees and an angle greater than 90 degrees.

4. The system according to claim 2, wherein each hollow telescoping vertical leg comprises:
   a. a first hollow metal cylinder having an inner surface with a first diameter and a port near one end of the cylinder; and
   b. a second hollow metal cylinder having an outer surface with a second diameter and a retractable button capable of fitting into the port, wherein the second diameter being less than the first diameter.

5. The system according to claim 3, wherein the telescoping frame is stored by locking the hinges at 90 degrees and sliding each second hollow metal cylinder up into the first hollow metal cylinder, placing the frame against the foam backpanel, and securing the telescoping frame and the foam backpanel within the integrated sleeve such that the foam backpanel is closer to a user's back and the frame is on the inside of the pack such that it forms a support structure capable of cushioning the user's back and spreading a load more evenly over a wide surface area.

6. The system according to claim 1, wherein the integrated sleeve comprises an elastic band sewn to the inner back of the pack to store the frame.

7. The system according to claim 1, wherein the integrated sleeve is capable of storing a laptop or a water bladder.

8. The system according to claim 1, wherein the rain poncho is capable of being deployed as a standalone garment without the pack or tent.

9. The system according to claim 1, wherein the rain poncho comprises an adjustable hood, a portion adapted to cover at least a portion of a user's body, and a portion adapted to cover the backpack.

10. The system according to claim 9, wherein the rain poncho comprises snap buttons or hook-and-loop fasteners adapted to decrease the length of the pack cover portion, on the side of the user's back.

11. The system according to claim 1, wherein the zippered front pocket must be opened to deploy the tent,
   wherein the base of the tent comprises a waterproof floor shaped like two trapezoids that share a common base.

12. The system according to claim 11, wherein the tent is capable of being formed by expanding the telescoping frame and locking adjustable hinges in the telescoping frame to an angle greater than 90 degrees, forming three legs of a trapezoid without the longer base, and the frame legs are run through pole sleeves attached to the exterior of the tent and anchored in grommets in the base of the tent.

13. The system according to claim 12, wherein a portion of a tent wall and a portion of a tent roof are constructed of bug-mesh with one vertical and one horizontal zipper meeting at a common point on one wall.

14. The system according to claim 12, wherein:
   a horizontal frame arm is clipped to the top of the tent via clips,
   the walls and roof on a side of the pole sleeves opposite the side closer to the backpack are constructed of waterproof fabric, or a combination thereof.

15. The system according to claim 12, wherein the tent roof has bumpers sewn into the seams to direct water off the roof.

16. The system according to claim 12, wherein, at an end of the tent opposite the backpack, the foam backpanel is placed in a vented sleeve constructed of layers of waterproof fabric and bug mesh and connected to the floor, walls, and ceiling of the tent.

17. The system according to claim 12, wherein a flap attached to the roof above the integrated sleeve is configured to be over the sleeve and backpanel and is configured to be anchored to the ground.

18. The system according to claim 1, wherein stakes are placed through loops in a base of the tent and anchored to the ground to provide more wall tension.

19. The system according to claim 1, wherein the rain poncho can be removed from the pack and used as a rainfly.

20. The system according to claim 19, wherein grommets on the rainfly are capable of being placed underneath tent grommets and secured to tent poles, clips on the rainfly are capable of clipped onto a horizontal frame arm, stakes are capable of being placed through loops on the rainfly to provide wall tension, and at least one stake is capable of being placed through a rain poncho hood drawstring and a pack carrying handle to provide tension and create channels to direct water off the roof.

* * * * *